United States Patent [19]

Emmer

[11] Patent Number: 4,742,658

[45] Date of Patent: May 10, 1988

[54] FRAME STRUCTURE

[75] Inventor: Hans Emmer, Liestal, Switzerland

[73] Assignee: Eltreva AG, Aesch, Switzerland

[21] Appl. No.: 925,958

[22] Filed: Nov. 3, 1986

[30] Foreign Application Priority Data

Nov. 2, 1985 [DE] Fed. Rep. of Germany ..... 3539003

[51] Int. Cl.[4] ..... E04B 2/96

[52] U.S. Cl. ..... 52/235; 52/718.1

[58] Field of Search ..... 52/717, 718, 235, 463; 24/291, 297, 296, 292

[56] References Cited

U.S. PATENT DOCUMENTS

| | | | |
|---|---|---|---|
| 3,034,615 | 5/1962 | Kern | 24/292 |
| 3,038,223 | 6/1962 | Fiddler | 24/292 |
| 4,342,139 | 8/1982 | Tanaka | 24/292 |

FOREIGN PATENT DOCUMENTS

| | | |
|---|---|---|
| 30 48 152 | 6/1982 | Fed. Rep. of Germany . |
| 580210 | 9/1976 | Switzerland . |

*Primary Examiner*—John E. Murtagh

*Attorney, Agent, or Firm*—Foley & Lardner, Schwartz, Jeffery, Schwaab, Mark, Blumenthal & Evans

[57] ABSTRACT

A frame structure consisting of two compound units provided with mutually facing grooves undercut on either side, in which the first compound unit can be attached in a desired position to the second compound unit via a detachable coupling which comprises a turning part which can be turned from the outside manually via a handle about its longitudinal axis by about 90° into its coupling or decoupling position, and which in its coupling position positively engages by means of a T-head at its one end in one of the two grooves and by means of anchoring means at its other end in the other of the two grooves and can be locked in this coupling position by means of an anti-rotation device. To connect the two compound units to each other without special tools, but above all to be able also to detach them from each other again, it is proposed according to the invention that the anchoring means comprise a punched part which is arranged longitudinally displaceably in the one groove and bears the turning part which is freely rotatable relative to it and that the handle comprise a resilient element connected securely against rotation to the turning part, which element in decoupling position extends in relieved state or under only slight stress between the two compound units and in coupling position engages under bending stress behind a holder.

14 Claims, 3 Drawing Sheets

FRAME STRUCTURE

BACKGROUND OF THE INVENTION

This invention relates to a frame structure comprising two compound units provided with mutually facing grooves undercut on either side, in which the first compound unit can be attached in a desired position to the second compound unit via a detachable coupling, which consists of a turning part which can be turned from the outside manually via a handle about its longitudinal axis by about 90° into its coupling or decoupling position, engages positively in its coupling position by means of a T-head at its one end in one of the two grooves and by means of anchoring means at its other end in the other of the two grooves and can be locked in this coupling position by means of an anti-rotation device.

Such an arrangement is described in Swiss Pat. No. 580,210, which discloses a facade structure in which one compound unit is a flatly configured cover profile overlapping at least one plate element, in the groove of which cover profile the turning part is held by its T-head, while the other compound unit is a post profile, in the groove of which the turning part engages by two parallel fork arms, which are provided with snap-in lugs, and thus effect an anchorage in the undercut groove. The turning part consists of at least two parts which can be turned relative to each other, one of which bears the T-head and the other the parallel fork arms. The two parts are held together by at least one screw forming the common axis. The part of the turning part provided with the T-head has opposite areas for fitting a wrench. With the aid of a wrench, this part can therefore be turned relative to the other part. It is also possible, however, for a handle to be molded as an integral component on the T-head part for turning this part. The fork part is fixed in the groove of the post profile by pressing in, if necessary by a blow. The screw is fixed, for example cast, in the T-head part. By turning the T-head part, the screw is turned further into the fork part and thereby exerts a spreading pressure on the fork arms and thus secures the fork part against dropping out.

This structure is complex to manufacture and assemble and does not offer adequate reliability against unintended detachment of the turning part.

SUMMARY OF THE INVENTION

The invention is thus based on the object of improving the aforedescribed frame structure with regard to the manageability and operational reliability of the coupling.

This object is achieved according to the invention by providing anchoring means consisting of a slide piece which is arranged longitudinally displaceably in the one groove and bears the turning part and by the handle consisting of a resilient element connected securely against rotation to the turning part, which element extends in the decoupling position between the two compound units and in coupling position engages under bending stress behind a holder.

The slide piece may be a punched part in which the turning part is mounted so as to be freely rotatable. However, the slide piece may also be a circular disk which is connected securely against rotation to the turning part. In other words the slide may be designed as an integral part of the turning part. It is not critical to the invention how the punched part is made. The chosen designation "punched part" is merely intended to indicate that it may be a simply and inexpensively produced sheet metal part.

Owing to the resilient design of the handle, there is on the one hand a good locking capability for the turning part, and on the other hand the handle can "hide" from view in the coupling position.

To achieve a high clamping force between the two compound units and to ensure the maintenance of this clamping force even under the influence of external forces acting on the frame structure, it is advantageous if the T-head has two opposite abutting bevels on its surface which faces the flanges forming the boundary of the associated groove. In addition, it is advantageous if the flange sides facing the abutting bevels are designed slightly obliquely and/or conically.

In addition, it is advantageous if the turning part has a plate-shaped contact member lying between the two compound units, which contact member is pressed in the coupling position in an axial direction against a seal positioned over the second compound unit. When the turning part is turned into the coupling position, the clamping force described above presses the plate-shaped contact member in an axial direction against the seal. The contact member has the advantage that the handle can be turned virtually without resistance with respect to the seal.

In an advantageous embodiment, the handle may be a wire spring inserted through the turning part, which wire spring engages in coupling position under bending stress by at least one end behind a holding leg of the one compound unit.

In a further embodiment of the invention, it is advantageous if, in decoupling position, at least one end of the wire spring extends under slight stress beyond the holding leg. This makes it possible for the turning parts to be held in precise position after preassembly of the slide pieces in the cover profile. In the previously known devices of this general type, T-heads, eccentrics or the like cannot be held in desired position, in other words in their decoupling position, during the assembly operation without additional tools. In the embodiment according to the invention, a fast assembly operation is ensured since several slide pieces can be preassembled with their turning part in a cover profile, and the projecting end of the wire spring engaging under the holding leg will prevent a displacement of these compound units during the assembly.

In a modified embodiment, the slide piece may be a fork-shaped plate which is positioned under a disk-shaped turning head of the turning part protruding into a groove and, in the coupling position engages, with its head end on the one hand and with its two fork ends on the other hand, behind the two flanges of the first compound unit and in this position snaps into an interlocking member of a flat intermediate piece, which is pushed between the resilient element and the fork-shaped plate through an oblique slot onto the turning part, and which lies between the flanges.

This embodiment has the advantage that impressions in the form of locking lugs or the like may be dispensed with. Above all, however, it is possible to assemble the holder in any desired position in the first compound unit without the holder parts having to be pushed in over, or slid along, the entire length of this compound unit or cover profile.

Further features of the invention are explained in more detail with reference to illustrative preferred embodiments described hereinafter.

BRIEF DESCRIPTION OF THE DRAWINGS

Three embodiments of the invention are diagrammatically represented as examples in the drawings, in which.

DETAILED DESCRIPTION OF PREFERRED EMBODIMENTS

Figure 1:
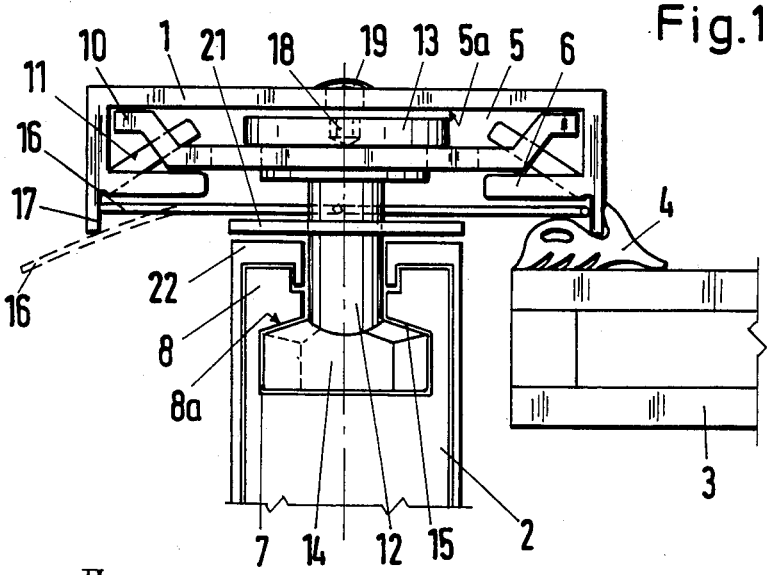
FIG. 1 shows a horizontal cross-section through a section of a first embodiment of a frame structure according to the invention.

FIG. 1 shows a cross-section through a compound unit 1, which is formed by a flat cover profile and, in cross-section, a compound unit 2 in the form of a post profile. Provided between the two compound units 1 and 2 is a detachable coupling, with which the cover profile can be attached to the post profile 2, but can if necessary also be detached again from the post profile. The cover profile 1 overlaps with a plate element 3, which is represented as insulated window glazing. A seal 4 is pressed in between plate element 3 and cover profile 1.

The cover profile 1 has an undercut groove 5 extending in the profile direction which is bounded on the side facing the post profile 2 by flanges 6 designed as profile webs. The post profile 2 also has an undercut groove 7 extending in the profile longitudinal direction, which is bounded on its side facing the cover profile by flanges 8 which are designed slightly conically on their inside surface 8*a* facing the groove 7. The two grooves face each other.

Figure 2:
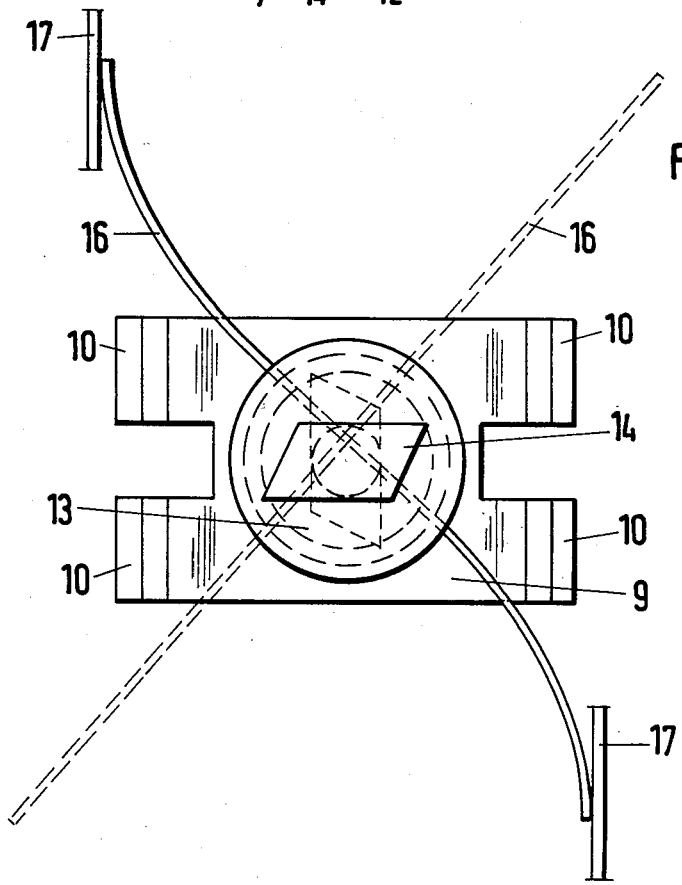
FIG. 2 shows a number of parts of the structure illustrated in FIG. 1, in plan view.

Displaceably guided in the groove 5 of the cover profile 1 is a punched part 9 which has, in plan view, approximately the shape of an H as shown in FIG. 2. The four leg ends 10 of the H are bent back and lie against the base 5*a* of the associated groove 5, while the rest of punched part 9 bears against the two flanges 6. In order to fix the punched part 9 within the associated groove 5, locking lugs 11, designed for example as profile webs, are pressed out of the flanges 6 of this groove between the H legs.

The coupling comprises a turning part 12 which, in the hollow space defined by the leg ends 10 of the punched part 9 and the groove base 5a, lies with a disk-shaped turning head 13 against the punched part 9. Turning part 12 is mounted by a section of smaller diameter in a corresponding recess of punched part 9 so as to be freely rotatable, and has at its opposite end a T-head 14 which extends into the groove 7 of the post profile 2. T-head 14 has on its surface, which faces the flanges 8 defining the boundary of the associated groove 7, two opposite abutting bevels 15, which correspond to the conical inner surface 8a of the flanges 8. A wire spring 16 is inserted through the shank of the turning part 12, and the ends of spring 16 extend out from between the two compound units 1 and 2 when the turning part 12 is in its decoupling position as shown in broken lines in FIGS. 1 and 2. As can be seen clearly from the broken line representation in FIG. 1, wire spring 16 extends under slight stress beyond holding leg 17 when in the decoupling position. When the turning part 12 is in the coupling position, the ends of the wire spring 16 engage under bending stress behind holding legs 17 of the cover profile 1.

A recess 18 for a turning tool, for example a hexagonal socket, may additionally be provided in the turning head 13 of the turning part 12. Recess 18 is aligned with a through-opening provided in the associated compound unit 1, and the through-opening is closed off by a plug 19.

After the turning part 12 has been inserted into the punched part 9, the punched part is pushed into the groove 5 of cover profile 1 and fixed in the desired position by pushing out the locking lugs 11. To attach the cover profile 1 to the post profile 2, the turning part 12 is turned into its decoupling position as shown in broken lines in FIG. 2 and then the flat end of T-head 14 is pushed into the groove 7 of the post profile 2. Using the wire spring 16, the turning part 12 can then be turned through approximately 90° into its coupling position. As this happens, the abutting bevels 15 of T-head 14 engage the conical inside surface 8*a* of the flanges 8 and thereby firmly clamp the cover profile 1 against the post profile 2. In order to lock the turning part 12 in its coupling position, the ends of the wire spring 16 are clamped behind the holding legs 17 of the cover profile 1, as shown by solid lines in FIG. 2. By detaching the wire spring 16 and turning back the turning part 12 through approximately 90°, a decoupling between the compound units 1 and 2 can be quickly and easily achieved.

Turning part 12 may comprise a plate-shaped contact member 21 which lies between the two compound units 1 and 2. When turning part 12 is turned to the coupling position, contact member 21 is pressed axially toward compound unit 2 and contacts a seal member 22 which is disposed over the end of compound unit 2 to produce a seal between the units.

The above-mentioned hexagonal socket 18 for actuating the turning part 12 with a wrench is not essential. Use of the socket and a wrench to effect this manipulation also additionally requires a through-opening in the cover profile 1. The production of this through-opening is complex as it must be aligned with the hexagonal socket of the turning part 12. Such through-openings in the profile may also be disadvantageous because they may adversely affect the visual appearance of the structure.

In the facade structure embodiment shown in the drawings, after attaching the cover profile 1 to the post profile 2, the seal 4 is pressed between the already preassembled plate element 3 and the cover profile 1. This seal forms an additional safeguard against unintended turning back of the turning part 12 into its decoupling position.

Figure 3:
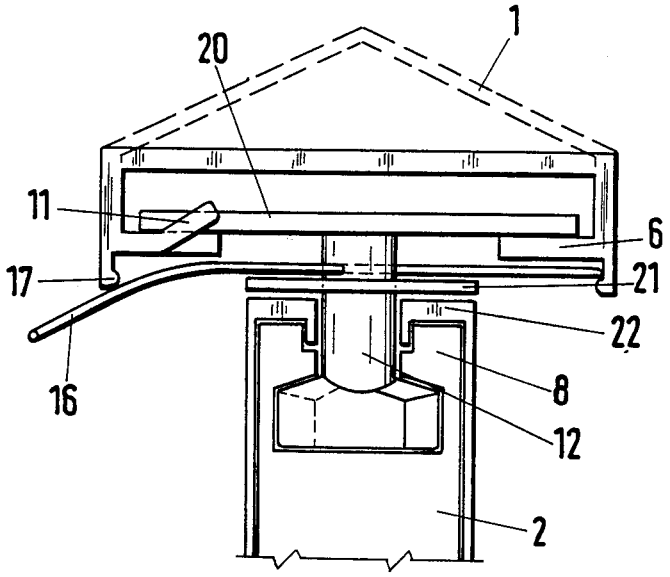
FIG. 3 is a horizontal cross-section showing a modified embodiment of the invention.

The alternate embodiment illustrated in FIG. 3 corresponds substantially to that shown in FIG. 1. It is indicated in dotted lines that the compound unit 1 may also have a triangular cross-sectional contour. The slide piece in this embodiment is formed by a circular disk 20, which is designed as an integral part of the turning part 12. The positioning of the turning part in the cover profile 1 is performed by face-sided pushing of the turning part into the cover profile. The turning part remains fixed in the desired position in the cover profile once at least one end of the wire spring 16 engages under slight stress with the holding leg 17. Vertically installed cover profiles may be additionally secured against slipping by means of local locking lugs 11 positioned in each case above a disk 20.

Figure 4:
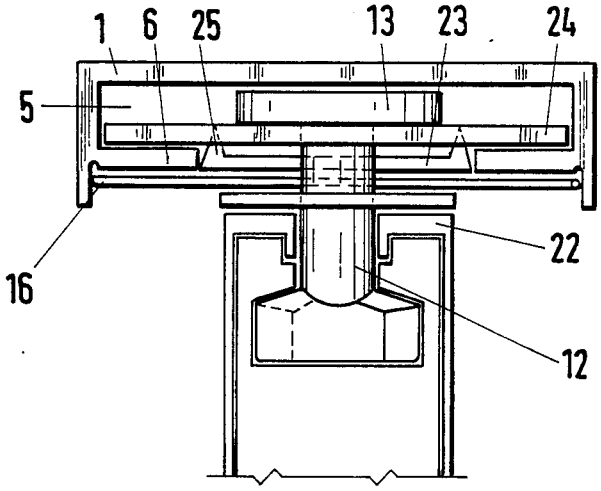
FIG. 4 shows a further modified embodiment in a view corresponding to FIG. 3.
Figure 5:
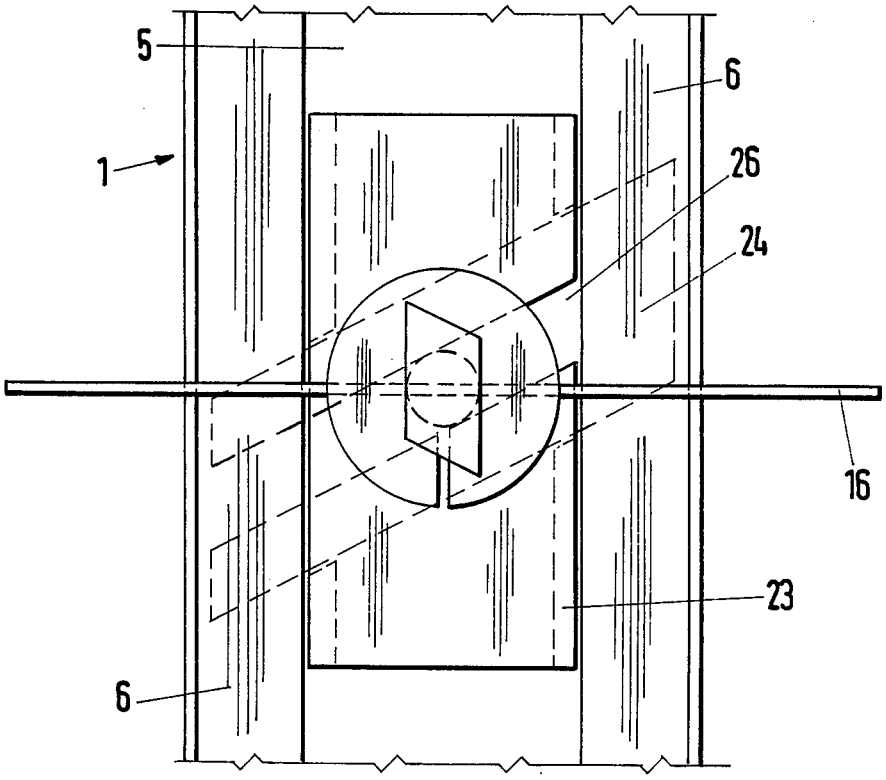
FIG. 5 shows the embodiment of FIG. 4 in a view corresponding to FIG. 2.

In the embodiment illustrated in FIGS. 4 and 5, the slide piece is formed by a fork-shaped plate 24, which is positioned under the disk-shaped turning head 13 of the turning part 12 protruding into the groove 5 of the first compound unit 1 and which, in coupling position, is engaged with its head end on the one hand and with its two fork ends on the other hand on top of the two flanges 6 of compound unit 1. In this position, the fork-shaped plate 24 snaps into an interlocking member 25 of a flat intermediate piece 23, which preferably is formed of synthetic resin. Intermediate piece 23 is pushed between the resilient element 16 and the fork-shaped plate 24 onto the turning point 12 through a slot 26 extending obliquely with respect to compound unit 1, and extends between the two flanges 6.

In order to assemble this holder, the fork-shaped plate 24 is pushed, together with the turning part 12 which has previously been positioned in the fork slot in plate 24 and with the handle 16 which has previously been connected to turning part 12, parallel to the compound unit or cover profile 1 between its flanges 6 into groove 5. The fork-shaped plate 24 is then turned slightly until it assumes the diagonal position represented in FIG. 5. In this coupling position, the fork-shaped plate 24 is engaged behind the two flanges 6. To lock the fork-shaped plate 24 in this coupling position, a flat intermediate piece 23 is provided, the width of which corresponds precisely to the clear distance between the two flanges 6. This intermediate piece is then pushed in the manner described above onto turning part 12 - with turning part 12 received in the obliquely extending slot 26 which is open only on one longitudinal side of intermediate piece 23 - until intermediate piece 23 lies precisely between the two flanges 6, and underside ribs 25 on intermediate piece 23 form an interlock with the fork-shaped plate 24.

The advantage of this embodiment is that the holder can be firmly clamped directly in the desired position on the cover profile 1, without the holder having to be pushed along the entire length of the cover profile into the desired position and without the desired position having to be fixed by impressions or punch outs or the like.

The foregoing description has been set forth merely to illustrate the invention and is not intended to be limiting. Since modifications of the described embodiments incorporating the spirit and substance of the invention may occur to persons skilled in the art, the scope of the invention should be limited solely with respect to the appended claims and equivalents.

I claim:

1. A frame structure comprising first and second compound units provided with mutually facing grooves undercut on either side, wherein said first compound unit can be attached in a desired position to the second compound unit via a detachable coupling, said coupling comprising a turning part which can be turned from the outside manually via a handle around a longitudinal axis by about 90° between a coupling position and a decoupling position, said turning part having at one end a T-head which in the coupling positio positively engages the groove of one of said compound units and at another end anchoring means which positively engage the groove of the other of the compound units, said coupling further comprising an anti-rotation device for locking said turning part in the coupling position, said anchoring means comprising a slide piece which is arranged longitudinally displaceably in the groove of said other compound unit and which bears the turning part, and said handle comprising a resilient element connected securely against rotation to the turning part, said resilient element in the decoupling position extending out from between the two compound units and in the coupling position being engaged under bending stress behind a holder.

2. A frame structure according to claim 1, wherein the slide piece is a punched part in which the turning part is mounted freely rotatably.

3. A frame structure according to claim 2, wherein:

(a) the punched part has, in plan view, approximately the shape of an H with four leg ends;

(b) the four leg ends of the punched part lie against the base of the groove engaged by the anchoring means, while the punched part bears against two flanges forming the boundary of the groove;

(c) a disk-shaped turning head of the turning part is disposed in a hollow space defined by the leg ends and the groove base; and (d) locking lugs designed as profile webs are pressed out of the flanges of said groove between the H legs for fixing the punched part within the associated groove.

4. A frame structure according to claim 3, wherein said leg ends of the punched part are bent back.

5. A frame structure according to claim 1, wherein the slide piece is a circular disk which is connected securely against rotation to the turning part.

6. A frame structure according to claim 1, wherein the slide piece is a fork-shaped plate positioned under a disk-shaped turning head of the turning part protruding into the groove of said other compound unit and which in the coupling position engages with its head end on the one hand and with its two fork ends on the other hand behind two flanges which define the groove of said other compound unit and in this position snaps into an interlocking member of a flat intermediate piece which is pushed between the resilient element and the fork-shaped plate through an oblique shot onto the turning part and lies between said flanges.

7. A frame structure according to claim 1, wherein the T-head has two opposite abutting bevels on its surface which faces the flanges forming the boundary of the associated groove.

8. A frame structure according to claim 7, wherein the flange sides facing said abutting bevels have a slightly conical configuration.

9. A frame structure according to claim 1, wherein the turning part comprises a plate shaped contact member which lies between the two compound units and which in the coupling position is pressed in an axial direction against a seal member disposed on the second compound unit.

10. A frame structure according to claim 1, wherein said handle comprises a wire spring which is inserted throuh said turning part and which engages in the coupling position with at least one end under bending stress behind a holding leg on said other compound unit.

11. A frame structure according to claim 10, wherein in the decoupling position at least one end of said wire spring extends under slight stress beyond the holding leg.

12. A frame structure according to claim 1, wherein the turning part has a recess for a turning tool which is aligned with a through-opening provided in the associated compound unit, and said through-opening can be closed off by a plug.

13. A frame structure according to claim 12, wherein said recess is a hexagonal socket.

14. A facade structure comprising a frame structure according to claim 1, wherein said one compound unit is a cover profile which overlaps at least one plate element; the slide piece is guided in the groove of the cover profile; said other compound unit is a post profile; and a seal is pressed between said plate element and said cover profile.

* * * * *